US011676790B2

(12) United States Patent
Lavoute et al.

(10) Patent No.: US 11,676,790 B2
(45) Date of Patent: Jun. 13, 2023

(54) PHOTOCATHODE WITH IMPROVED QUANTUM YIELD

(71) Applicant: PHOTONIS FRANCE, Brive (FR)

(72) Inventors: Pascal Lavoute, Brive la Gaillarde (FR); Gert Nützel, Delf (NL)

(73) Assignee: PHOTONIS FRANCE, Brive (FR)

( * ) Notice: Subject to any disclaimer, the term of this patent is extended or adjusted under 35 U.S.C. 154(b) by 30 days.

(21) Appl. No.: 17/595,661

(22) PCT Filed: May 22, 2020

(86) PCT No.: PCT/HR2020/000176
§ 371 (c)(1),
(2) Date: Nov. 22, 2021

(87) PCT Pub. No.: WO2020/234518
PCT Pub. Date: Nov. 26, 2020

(65) Prior Publication Data

US 2022/0223364 A1 Jul. 14, 2022

(30) Foreign Application Priority Data

May 23, 2019 (FR) ..... 1905412

(51) Int. Cl.
*H01J 29/08* (2006.01)
*H01J 31/26* (2006.01)
*H01J 31/50* (2006.01)

(52) U.S. Cl.
CPC ..... *H01J 29/08* (2013.01); *H01J 31/26* (2013.01); *H01J 31/506* (2013.01)

(58) Field of Classification Search
CPC ..... H01J 29/08; H01J 31/26; H01J 31/506
See application file for complete search history.

(56) References Cited

U.S. PATENT DOCUMENTS

2002/0168198 A1* 11/2002 Imai ..... H01L 27/14623 399/153
2007/0096648 A1 5/2007 Nakajima et al.
2014/0239157 A1 8/2014 Burgess et al.

FOREIGN PATENT DOCUMENTS

FR 2925218 A 6/2009
WO 2009074682 A2 6/2009

OTHER PUBLICATIONS

Search Report issued in French Patent Application No. 1905412 dated Jan. 30, 2020.
International Search Report for Application No. PCT/FR2020/000176 dated Sep. 14, 2020.
Written Opinion for PCT/FR2020/000176 dated Sep. 14, 2020.

* cited by examiner

*Primary Examiner* — Anne M Hines
(74) *Attorney, Agent, or Firm* — Pearne & Gordon LLP

(57) ABSTRACT

An electromagnetic radiation detector includes an inlet window intended to receive a stream of incident photons, as well as a photocathode in the form of a semiconductive layer. A conductive layer is deposited on the downstream face of the inlet window and a thin dielectric layer is disposed between the conductive layer and the semiconductive layer. The conductive layer is brought to a potential below that of the semiconductive layer so as to drive the photoelectrons out of the recombination zone and consequently improve the quantum yield of the photocathode.

9 Claims, 4 Drawing Sheets

PHOTOCATHODE WITH IMPROVED QUANTUM YIELD

This is the National Stage of PCT international application PCT/FR2020/000176, filed on May 22, 2020 entitled "PHOTOCATHODE WITH IMPROVED QUANTUM YIELD", which claims the priority of French Patent Application No. 1905412 filed May 23, 2019, both of which are incorporated herein by reference in their entirety.

TECHNICAL FIELD

The present invention relates to the general field of photocathodes such as those used in image intensifiers or photomultiplier tubes.

PRIOR ART

Electromagnetic radiation detectors, such as image intensifier tubes or photomultiplier tubes, allow detecting an electromagnetic radiation in a given spectral band by converting it into a light or electric output signal.

In general, these detectors include a photocathode for receiving the electromagnetic radiation and emitting a flux of photoelectrons in response, an electron multiplier device for receiving said flux of photoelectrons and emitting a flux of so-called secondary electrons in response, and finally an output device for receiving said flux of electrons and converting it into an output signal.

FIG. 1 represents an electromagnetic radiation detector known from the prior art.

As illustrated in the figure, such a detector, 100, comprises an inlet window made of a transparent material, 110, generally of glass, serving as a support for a photo-emitting layer or photocathode, 120, made of a semiconductor material. The inlet window has a front face, 111, intended to receive the flux of incident photons and a rear face, 112, opposite to the front face. The photo-emitting layer includes an upstream face, 121, in contact with the rear face of the inlet window and a downstream face 122, from which the photoelectrons are emitted.

The photocathode is set at a negative potential with respect to that applied at the electron multiplier device 130, the electron multiplier device itself being at a negative potential with respect to that applied at the output device 140, for example a phosphorus screen or a CCD array.

The photons impinging on the front face 111, cross the transparent window 110 and penetrate into the photo-emitting layer 120, where they generate electron-hole pairs if they have an energy higher than the band gap width of the semiconductor material. The photoelectrons migrate towards the downstream face, 122, of the photocathode where they are emitted in vacuum, before being multiplied by the electron multiplier device, 130, and converted into a light or electric signal by the output device, 140.

The quantum yield of the photocathode is conventionally defined as the ratio between the number of photoelectrons emitted by the photocathode and the number of received photons. The quantum yield of the photocathode is an essential parameter of the detector, it conditions both its sensitivity and its signal-to-noise ratio. In particular, it depends on the wavelength of the incident photons and on the thickness of the photo-emitting layer.

The quantum yield may be substantially degraded by the presence of defects at the interface between the photocathode, 120, and the transparent window, 110. More specifically, these defects create surface states trapping the photoelectrons generated in the photocathode. The photoelectrons trapped in the manner can no longer migrate towards the downstream face of the photocathode and therefore do not contribute to the photocurrent generated by the photoelectrons emitted by the photocathode.

This deterioration of the quantum yield of the photocathode is felt in particular in small wavelengths. Indeed, photons with higher energy interact earlier with the semiconductor along their path within the photocathode. Consequently, the photoelectrons generated by these photons are more likely to be trapped at the interface.

To overcome this deterioration of the quantum yield, it has been proposed to introduce, at the interface between the inlet window and the photocathode, an intermediate layer of a semiconductor material having a wider band gap than that of the photocathode. Thus, for example, if the photocathode is made of a III-V semiconductor material such as p-type GaAs, it is possible to introduce an intermediate layer of p-type GaAlAs at the interface. The wider band gap width of GaAlsAs with respect to GaAs creates an upward band bending on the photocathode side as shown in the band diagram of FIG. 2. Thus, when a photon generates an electron-hole pair proximate to the interface, the photoelectron is extracted out of the recombination area by the local electric field.

Nonetheless, this solution cannot be transposed to all photocathode types, in particular to those made of a polycrystalline material, for example of a bi- or multi-alkaline compound such as $SbK_2Cs$, $SbRb_2Cs$, $SbRb_2Cs$, $SbCs_3$, $SbNa_3$, SbNaKRbCs, SbNaKCs, $SbNa_2KCs$. Because of their polycrystalline structure, these photocathodes do not have a well-defined band diagram and it is difficult to provide for an intermediate layer of a second semiconductor material allowing obtaining the desired band bending at the interface with the polycrystalline material.

More generally, even for photocathodes made of a monocrystalline semiconductor material, it is not always easy to find a suitable second semiconductor material allowing obtaining both a mesh matching and the desired band bending with the semiconductor material forming the photocathode. This is problematic in particular for photocathodes made of a II-VI semiconductor material, such as CdTe.

Consequently, the present invention aims to provide an electromagnetic radiation detector having a photocathode made of a first semiconductor material, having a high quantum yield yet without requiring an intermediate layer made of a suitable second semiconductor material, between the inlet window and the photocathode.

DISCLOSURE OF THE INVENTION

The present invention is defined by an electromagnetic radiation detector comprising a glass inlet window having an upstream face intended to receive a flux of incident photons as well as a downstream face opposite to the upstream face, a photocathode in the form of a semiconductor layer, intended to generate photoelectrons from the incident photons and to emit said photoelectrons thus generated, an electron multiplier device configured to receive the photoelectrons emitted by the photocathode and to generate for each received photoelectron a plurality of secondary electrons and an output device configured to generate an output signal from said secondary electrons, the radiation detector being specific in that a transparent conductive layer is deposited over the downstream face of the inlet window and that a thin insulating layer is disposed between said conductive layer and the semiconductor layer, the conductive layer being electrically connected to a first electrode and the semiconductor layer being electrically connected to a second electrode, the first electrode being intended to be set at a potential lower than that applied at the second electrode.

In particular, the semiconductor layer may be made of a polycrystalline semiconductor material. This material may be selected from $SbK_2Cs$, $SbRb_2Cs$, $SbRb_2Cs$, $SbCs_3$, $SbNa_3$, SbNaKRbCs, SbNaKCs, $SbNa_2KCs$.

Alternatively, the semiconductor layer may be made of a III-IV or II-VI monocrystalline semiconductor material.

Typically, the transparent conductive layer is made of ITO or ZnO.

Advantageously, the thin insulating layer is made of a dielectric material having a breakdown voltage higher than 1 V/10 nm. In general, this thin insulating layer has a thickness of 100 to 200 nm. Advantageously, the dielectric material is selected from $Al_2O_3$, $SiO_2$, $HfO_3$.

Advantageously, the potential difference applied between the second electrode and the first electrode is selected higher than or equal to $$\frac{4\delta\sqrt{\varepsilon_s \Delta U_{bb} e N_a}}{\varepsilon_d}$$

where $\varepsilon_s$ and $\varepsilon_d$ are respectively the dielectric constants of the semiconductor layer and of the insulating layer, $\delta$ is the thickness of the insulating layer, $\Delta U_{bb}$ is the amplitude of the band bending in the absence of any applied potential difference, $N_a$ is the concentration of acceptors in the semiconductor layer and e is the charge of the electron.

BRIEF DESCRIPTION OF THE FIGURES

Other features and advantages of the invention will appear upon reading a preferred embodiment of the invention, described with reference to the appended figures where.

DESCRIPTION OF THE EMBODIMENTS

The underlying idea of the invention consists in introducing between the inlet window of the electromagnetic detector and the photocathode a capacitive structure formed by a thin conductive layer serving as a polarisation electrode, and by a thin dielectric layer. The polarisation electrode is intended to be polarised at a potential lower than that applied at the photocathode so as to evict the photoelectrons generated proximate to the interface out of the recombination area.

Figure 1:
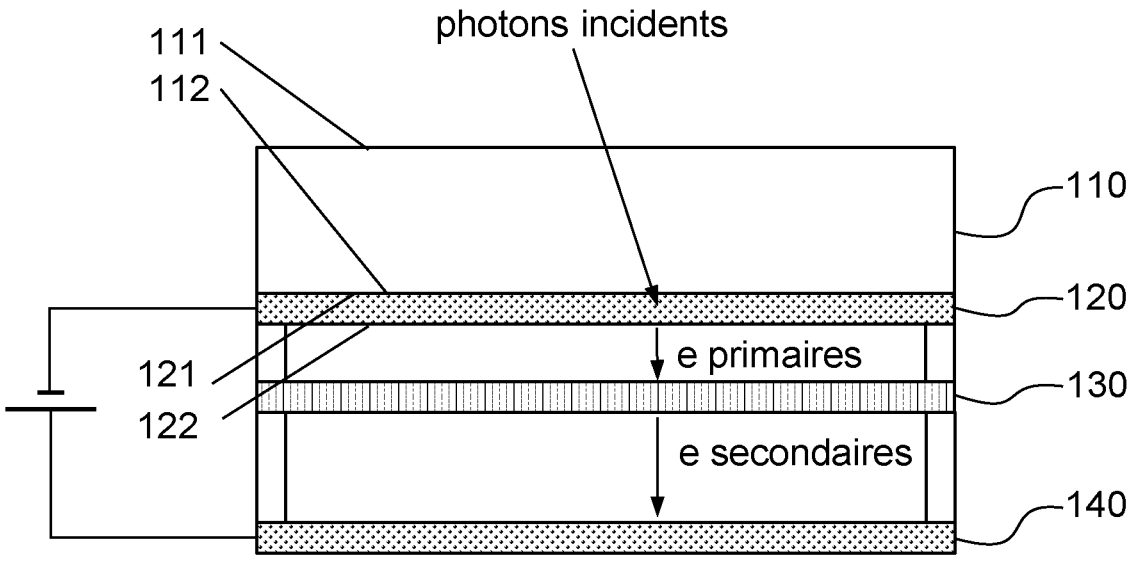
FIG. 1, already described, schematically represents the structure of an electromagnetic radiation detector known from the prior art.
Figure 2:
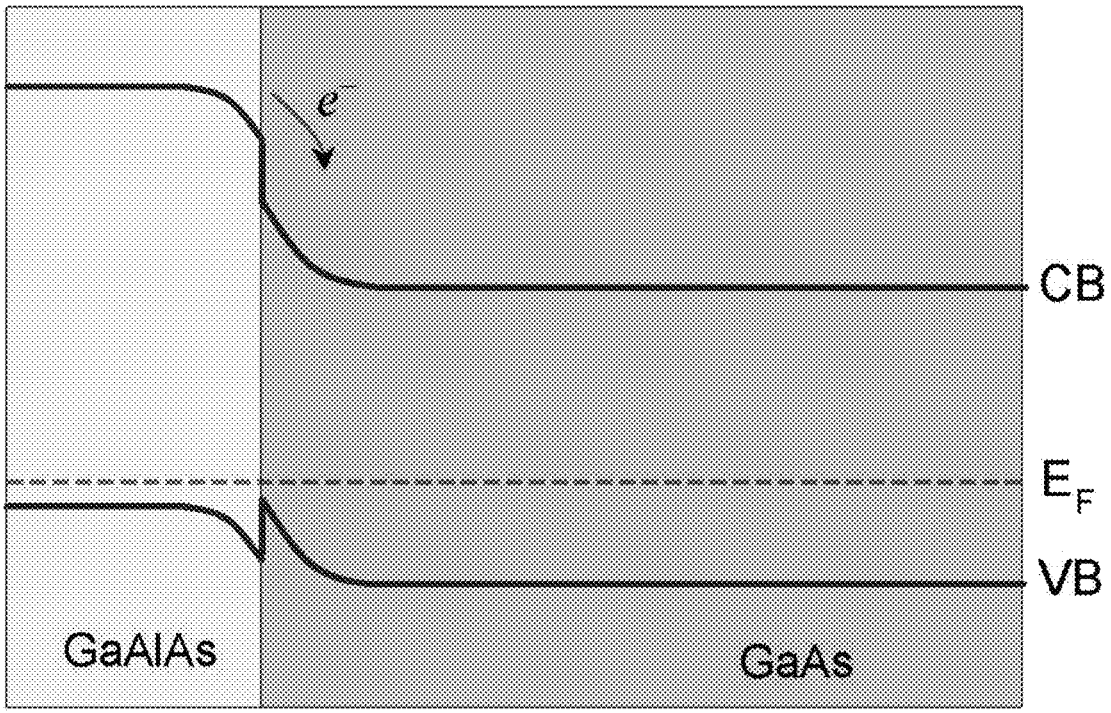
FIG. 2 represents the band diagram of a photocathode with a high quantum yield, known from the prior art.
Figure 3:
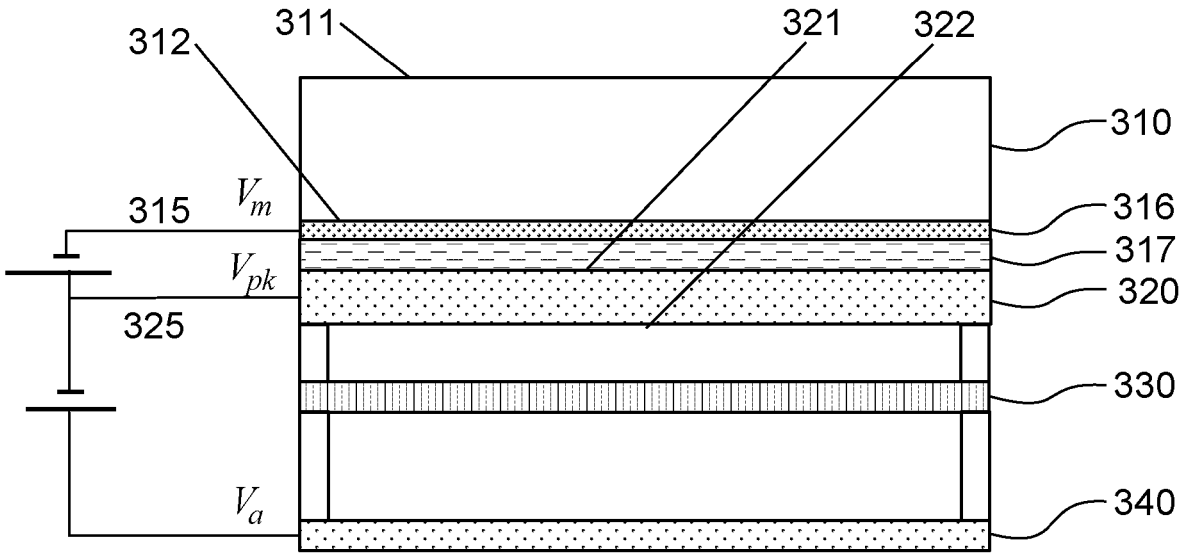
FIG. 3 schematically represents the structure of an electromagnetic radiation detector according to an embodiment of the invention.

FIG. 3 schematically represents the structure of an electromagnetic radiation detector according to an embodiment of the invention.

The detector comprises, like before, an inlet window, 310, made of a material transparent in the spectral band of interest, for example a window made of quartz or of borosilicate glass.

The inlet window has an upstream face, 311, intended to receive the flux of incident photons and a downstream face, 312, opposite to the upstream face.

A conductive layer, 316, transparent in the spectral band of interest, is deposited over the downstream face of the inlet window. It is further electrically connected to a first electrode 315. The transparent conductive layer may advantageously be made of ZnO or ITO. Its thickness is selected in the range from 50 to a few hundreds of nm and advantageously equal to 150 nm.

An insulating layer, 317, made of a dielectric material, is disposed between the conductive layer 316 and the semiconductor layer of the photocathode, 320. The dielectric material is selected so as to have a high breakdown voltage, for example higher than 1V/10 nm. The thickness of the dielectric layer is typically from 100 to 200 nm. In particular, the dielectric material may consist of alumina ($Al_2O_3$), silica ($SiO_2$), or a hafnium oxide ($HFO_3$). According to one variant, the insulating layer may be made in the form of a multilayer dielectric structure involving the aforementioned dielectric materials.

The photocathode 320 is made in the form of a semiconductor layer deposited over the insulating layer 317. The semiconductor may be monocrystalline, for example a III-V semiconductor, such as GaAs or a II-VI one, such as CdTe. Alternatively, it may have a polycrystalline structure, as could be the case in particular for bi- or multi-alkaline compounds such as $SbK_2Cs$, $SbRb_2Cs$, $SbRb_2Cs$, $SbCs_3$, $SbNa_3$, SbNaKRbCs, SbNaKCs, $SbNa_2KCs$.

In any case, the photocathode is electrically connected to a second electrode, 325.

The primary electrons emitted by the photocathode are emitted in vacuum and multiplied by an electron multiplier device, 330, for example a microchannel plate (MCP) or a nanocrystalline diamond layer as described in the published application FR-A-2961628 filed on the name of the present Applicant, or a discrete-dynode multiplier in the case of conventional photomultipliers.

The electron multiplier device is connected to a third electrode (not represented).

The photoelectrons multiplied in this manner, called secondary electrons, are received by the output device, 340. The output device may include a phosphorus screen, ensuring a direct conversion into an image like in an image intensifier or a CCD or CMOS array to output an electric signal representative of the distribution of the flux of incident photons, like in an EB-CCD (Electron Bombarded CCD) or EBCMOS (Electron Bombarded CMOS) system, or a simple metallic anode in the case of conventional photomultipliers.

The output device is connected to a fourth electrode serving as an anode.

The inlet window 310, the photocathode 320, the electron multiplier device, 330 and the output device are advantageously mounted in a compact tube body, the electrical connections of the electrodes with the external power supply being ensured by connecting rings separated by dielectric spacers. According to an advantageous variant, the tube body may be in the form of a multilayer ceramic substrate on which the electron multiplier device is fastened as described in the published application FR-A-2925218 filed on the name of the present Applicant.

Of course, like in a conventional photocathode, the extraction of the photoelectrons and the acceleration thereof is ensured by applying a high voltage between the anode and the cathode. Nonetheless, in an unconventional way, a negative voltage is applied between the first electrode and the second electrode so that the conductive layer is set at a potential lower than that of the photocathode. More specifically, if the respective potentials of the conductive layer, of the photocathode and of the anode are respectively denoted $V_m$, $V_{pk}$, $V_a$, then $V_m<V_{pk}<<V_a$. In other words, the potential difference between the conductive layer and the anode is essentially due to that between the photocathode and the anode. In practice, the potential difference $V_{pk}$-$V_m$ will be comprised between 1 and 50 V while the potential difference $V_a$-$V_{pk}$ is in the range of several hundred V.

The application of this voltage on the first electrode results in evicting the photoelectrons generated in the recombination area 321 towards the emission surface 322 of the photocathode. The recombination area of the photocathode is located at the interface with the dielectric layer. Indeed, a person skilled in the art should understand that the dislocations and defects at the interface with the dielectric layer serve as a centre of recombination of the photoelectrons. The stay time of the photoelectrons in the recombination area is very short because of the electric field applied between the conductive layer and the photocathode and reduces as much the likelihood of recombination thereof.

Furthermore, the transport of the photoelectrons within the photocathode is no longer due primarily to diffusion but also to the inner electric field. This results in a reduction of the average journey time of the electrons in the photocathode and an improvement of the response time of the photodetector.

Figure 4:
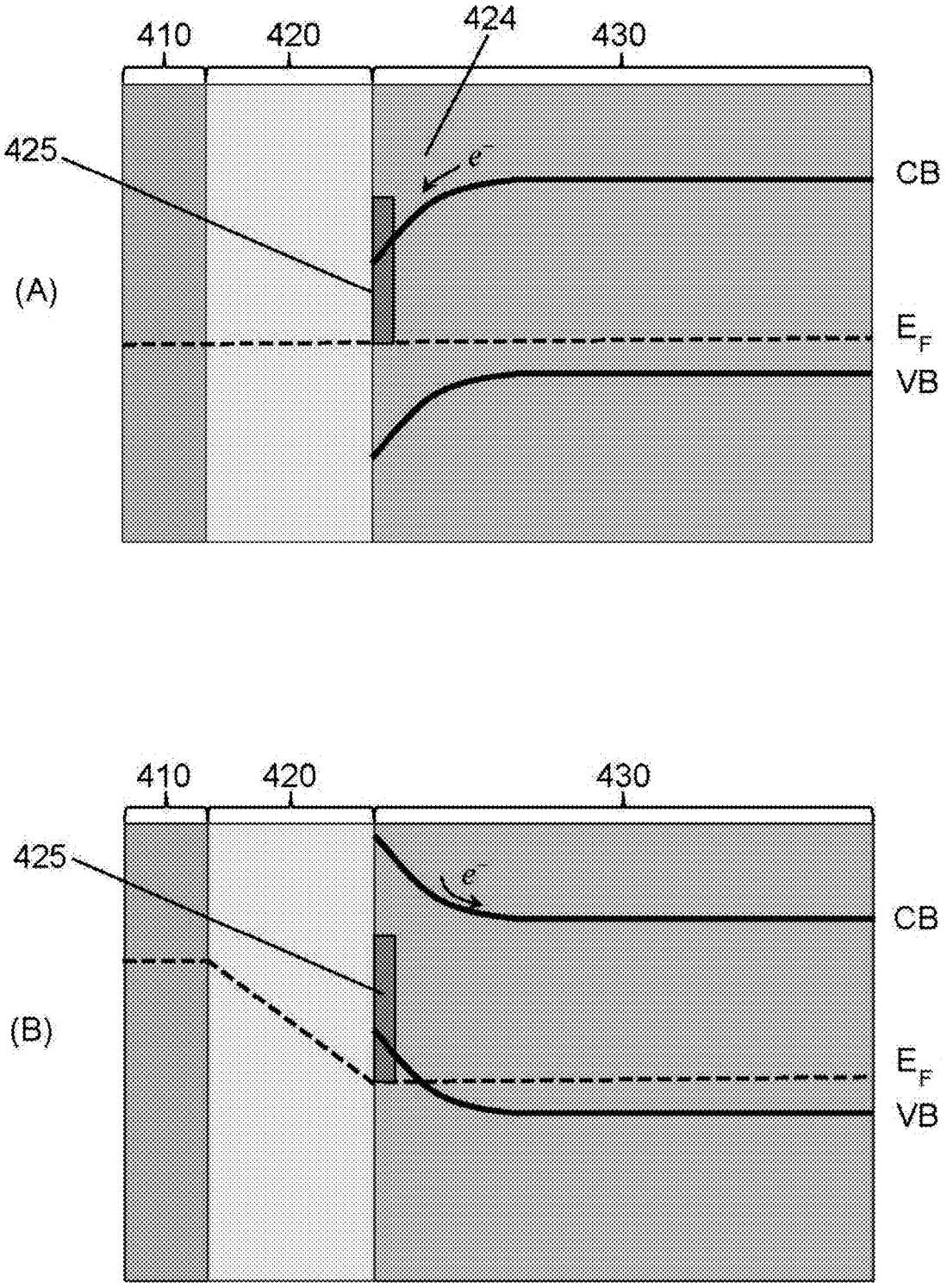
FIG. 4 represents the band diagram of a photocathode used in the electromagnetic radiation detector of FIG. 3.

FIG. 4 represents the band diagram of a photocathode used in the electromagnetic radiation detector of FIG. 3.

The conductive layer is indicated by 410, the insulating layer by 420 and the semiconductor layer of the photocathode by 430.

The top portion of the figure, referred to as (A), corresponds to the situation where no potential difference is applied between the conductive layer and the (p type) semiconductor layer.

It should be noted that the conduction and valence bands of the semiconductor layer are curved downwards at the interface with the insulating layer. In other words, in such a situation, a photoelectron gas is formed at the interface, in the potential cup 424. Moreover, the recombination area where the surfaces states are located is indicated by 425.

The photoelectrons generated at or close to the interface have a high likelihood of recombination with the surface states, that being even more as a photoelectron present in the potential cup will tend to migrate towards the recombination area.

The bottom portion of the figure, referred to as (B), corresponds to the situation where the conductive layer is set at a potential lower than that of the semiconductor layer. More specifically, the potential difference $V_{pk}$-$V_m$ is herein selected higher than a threshold value $\Delta V_{th}$ as explained later on.

It should be noted that the conduction and valence bands of the semiconductor layer are this time curved upwards at the interface with the insulating layer. In other words, in such a situation, the photoelectrons generated at the interface are evicted from the recombination area 425 by the electric field present in the bending area of the bands. The potential difference $V_{pk}$-$V_m$ to be applied could be estimated as follows: in the absence of any applied voltage (situation (A)), the (negative) space charge corresponding to the band bending balances the (positive) charge of the surface states. This space charge may be approximated by:

$$Q_b \simeq -eN_a x_{dt} \tag{1}$$

where e is the charge of the electron, $N_a$ is the concentration of acceptors in the (p type) photocathode and $x_{dt}$ is the width of the depletion area.

The width of the depletion area may be estimated by:

$$x_{dt} \simeq \sqrt{\frac{4\varepsilon_s \Delta U_{bb}}{eN_a}} \tag{2}$$

where $\varepsilon_s$ is the dielectric constant of the semiconductor and $\Delta U_{bb}$ is the band bending in the absence of any potential difference. This results in $Q_b \simeq -\sqrt{4\varepsilon_s \Delta U_{bb} e N_a}$.

Hence, the potential difference to be applied between the conductive layer and the photocathode allowing simply balancing this charge by capacitive effect in the photocathode amounts to:

$$(V_m - V_{pk})^{FF} = -\frac{Q_b}{C} = -\frac{Q_b}{\varepsilon_d}\delta \tag{3}$$

where the index FF corresponds to a situation where the bands are flat at the interface, $\delta$ is the thickness of the insulating layer and $\varepsilon_d$ its dielectric constant. In the case where it is desired at least to reverse the bending of the bands, then a potential difference $(V_m - V_{pk}) \leq -\Delta V_{th}$ should be applied with:

$$\Delta V_{th} \simeq \frac{4\delta\sqrt{\varepsilon_s \Delta U_{bb} e N_a}}{\varepsilon_d} \tag{4}$$

Nonetheless, a person skilled in the art should understand that an improvement of the quantum yield will be obtained when $V_m<V_{pk}$, to the extent that any reduction in the band bending, even before the reversal thereof, will reduce the width of the potential cup at the interface and will consequently reduce the likelihood of recombination of the photoelectrons.

What is claimed is:

1. An electromagnetic radiation detector comprising a glass inlet window having an upstream face intended to receive a flux of incident photons as well as a downstream face opposite to the upstream face, a photocathode in the form of a semiconductor layer, intended to generate photoelectrons from the incident photons and to emit said photoelectrons thus generated, an electron multiplier device configured to receive the photoelectrons emitted by the photocathode and to generate for each received photoelectron a plurality of secondary electrons and an output device configured to generate an output signal from said secondary electrons, wherein a transparent conductive layer is deposited over the downstream face of the inlet window and that a thin insulating layer is disposed between said conductive layer and the semiconductor layer, the conductive layer being electrically connected to a first electrode and the semiconductor layer being electrically connected to a second electrode, the first electrode being intended to be set at a potential lower than that applied at the second electrode.

2. The electromagnetic radiation detector according to claim 1, wherein the semiconductor layer is made of a polycrystalline semiconductor material.

3. The electromagnetic radiation detector according to claim 2, wherein the polycrystalline semiconductor material is selected from $SbK_2Cs$, $SbRb_2Cs$, $SbRb_2Cs$, $SbCs_3$, $SbNa_3$, SbNaKRbCs, SbNaKCs, $SbNa_2KCs$.

4. The electromagnetic radiation detector according to claim 1, wherein the semiconductor layer is made of a III-IV or II-VI monocrystalline semiconductor material.

5. The electromagnetic radiation detector according to claim 1, wherein the transparent conductive layer is made of ITO or ZnO.

6. The electromagnetic radiation detector according to claim 1, wherein the thin insulating layer is made of a dielectric material having a breakdown voltage higher than 1 V/10 nm.

7. The electromagnetic radiation detector according to claim 6, wherein the thin insulating layer has a thickness of 100 to 200 nm.

8. The electromagnetic radiation detector according to claim 1, wherein the dielectric material is selected from $Al_2O_3$, $SiO_2$, $HfO_3$.

9. The electromagnetic radiation detector according to claim 1, wherein the potential difference applied between the second electrode and the first electrode is selected higher than or equal to $$\frac{4\delta\sqrt{\varepsilon_s \Delta U_{bb} e N_a}}{\varepsilon_d}$$

where $\varepsilon_s$ and $\varepsilon_d$ are respectively the dielectric constants of the semiconductor layer and of the insulating layer, $\delta$ is the thickness of the insulating layer, $\Delta U_{bb}$ is the amplitude of the band bending in the absence of any applied potential difference, $N_a$ is the concentration of acceptors in the semiconductor layer and e is the charge of the electron.

* * * * *